US011905081B2

(12) United States Patent
Tsoukalis

(10) Patent No.: US 11,905,081 B2
(45) Date of Patent: Feb. 20, 2024

(54) PIZZA BOX TOY AND GAME DELIVERY DEVICES

(71) Applicant: PIZZA HAPPY, LLC, Boston, MA (US)

(72) Inventor: Nikitas Tsoukalis, Boston, MA (US)

(73) Assignee: Pizza Happy, LLC, Boston, MA (US)

( * ) Notice: Subject to any disclaimer, the term of this patent is extended or adjusted under 35 U.S.C. 154(b) by 720 days.

(21) Appl. No.: 16/775,933

(22) Filed: Jan. 29, 2020

(65) Prior Publication Data

US 2020/0307851 A1 Oct. 1, 2020

Related U.S. Application Data

(63) Continuation of application No. 16/542,877, filed on Aug. 16, 2019, now abandoned.

(Continued)

(51) Int. Cl.
*B65D 5/48* (2006.01)
*B65D 85/36* (2006.01)

(Continued)

(52) U.S. Cl.
CPC ..... *B65D 5/48* (2013.01); *A63H 3/36* (2013.01); *B65B 5/10* (2013.01); *B65B 25/16* (2013.01); *B65D 5/18* (2013.01); *B65D 85/36* (2013.01); *A63F 3/00261* (2013.01); *A63F 2003/00514* (2013.01); *A63F 2003/00955* (2013.01); *B65D 2585/366* (2013.01)

(58) Field of Classification Search
CPC . B65D 5/48; B65D 5/18; B65D 85/36; B65D 2585/366; B65D 5/48024; B65D 5/22; B65D 5/4233; B65D 5/5028; B65D 85/00; A63H 3/36; A63F 3/00261; A63F 2003/00514; A63F 2003/00955; A63F 2003/00949; A63F 2250/022; A63F 3/00895; A63F 2009/0012; A63F 9/001
USPC ..... 229/902, 199, 120.06; 426/104, 124; 206/525, 216
See application file for complete search history.

(56) References Cited

U.S. PATENT DOCUMENTS 4,877,609 A * 10/1989 Beck ..... B65D 85/36 294/7
5,385,292 A * 1/1995 Labianca ..... B65D 81/26 426/118

(Continued)

FOREIGN PATENT DOCUMENTS

CN 206735032 U * 12/2017
KR 200367531 Y1 * 11/2003

*Primary Examiner* — Christopher R Demeree
(74) *Attorney, Agent, or Firm* — Foley & Lardner LLP

(57) ABSTRACT

A delivery pizza may include a pizza box and pizza disposed therein. A toy container may be disposed in a gap of the pizza region between the pizza and adjacent sidewalls of the pizza box. In another embodiment, a toy partition member may be used to separate the toy from the pizza. A toy container may be configured to be supported by an in-store pizza on a pizza tray. A board game delivery device may alternatively be included in the pizza box to include a board game delivery device to enable a board game and accessory pieces therefor to be delivered to a consumer of the pizza. The board game may be positioned beneath the pizza, and game accessories may be disposed in storage regions defined by the board game delivery device.

6 Claims, 13 Drawing Sheets

Related U.S. Application Data

(60) Provisional application No. 62/821,917, filed on Mar. 21, 2019, provisional application No. 62/727,914, filed on Sep. 6, 2018, provisional application No. 62/764,866, filed on Aug. 16, 2018.

(51) Int. Cl.

| | |
|---|---|
| ***B65D 5/18*** | (2006.01) |
| ***A63H 3/36*** | (2006.01) |
| ***B65B 25/16*** | (2006.01) |
| ***B65B 5/10*** | (2006.01) |
| *A63F 3/00* | (2006.01) |

(56) References Cited

U.S. PATENT DOCUMENTS

| | | | | |
|---|---|---|---|---|
| 7,102,111 | B2 | 9/2006 | Metcalf et al. | |
| 7,331,459 | B2 | 2/2008 | Hilbourne | |
| 7,401,701 | B2 | 7/2008 | Daitch | |
| 8,042,728 | B2 * | 10/2011 | Braoudakis ..... | B65D 25/205 229/902 |
| 8,616,434 | B2 | 12/2013 | Wilen | |
| 2017/0355483 | A1 * | 12/2017 | Tsoukalis ..... | B65D 5/4233 |

* cited by examiner

2100

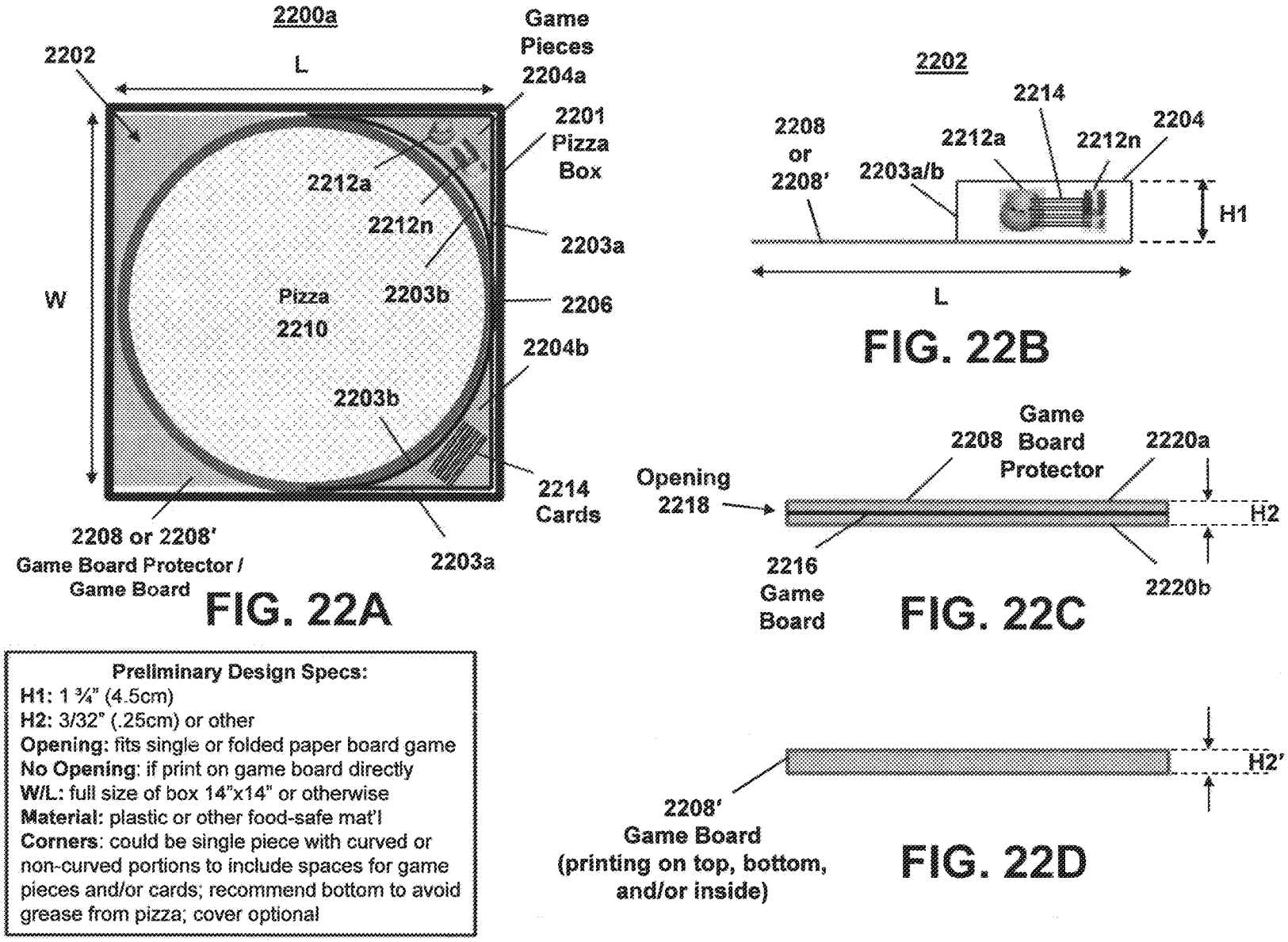

FIG. 22A

FIG. 22B

FIG. 22C

FIG. 22D

Preliminary Design Specs:

H1: 1 ¾" (4.5cm)
H2: 3/32" (.25cm) or other
Opening: fits single or folded paper board game
No Opening: if print on game board directly
W/L: full size of box 14"x14" or otherwise
Material: plastic or other food-safe mat'l
Corners: could be single piece with curved or non-curved portions to include spaces for game pieces and/or cards; recommend bottom to avoid grease from pizza; cover optional

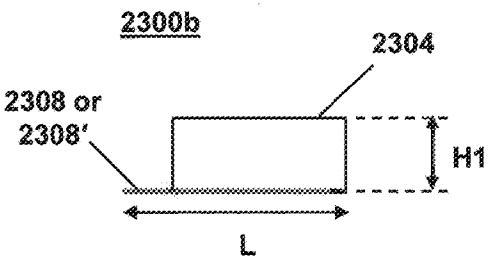

FIG. 23B

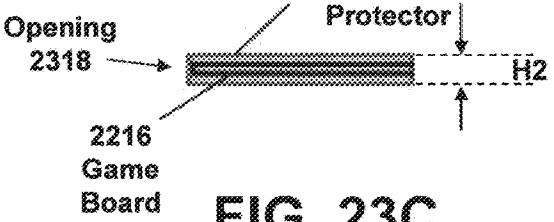

FIG. 23C

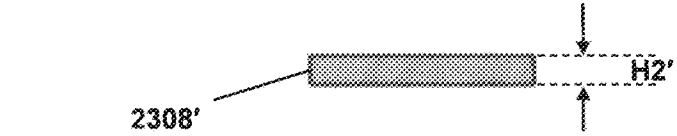

FIG. 23D

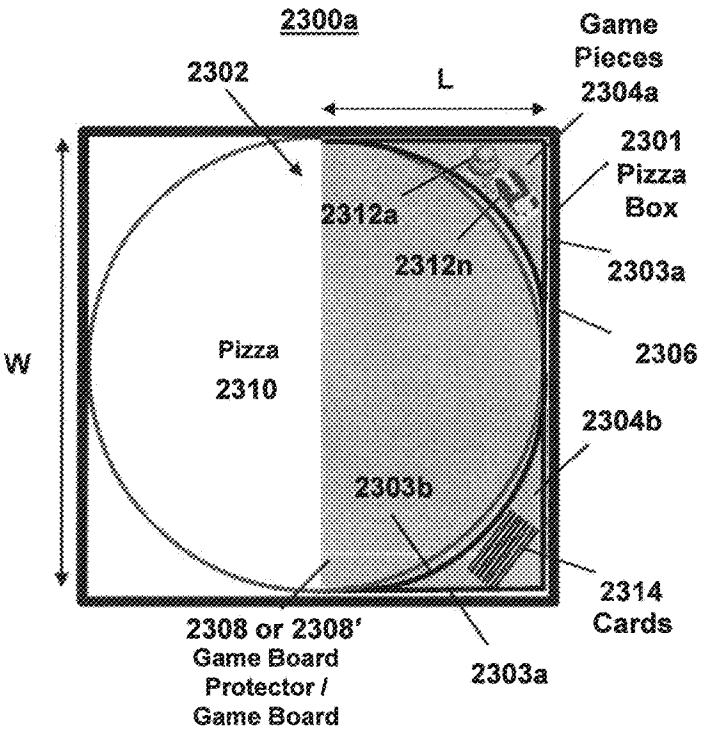

FIG. 23A

Preliminary Design Specs:

H1: 1 ¾" (4.5cm)
H2: 3/32" (.25cm) or other
Opening: fits single or folded paper board game
No Opening: if print on game board directly
W/L: half or quarter size of box 14"x14" or otherwise
Material: plastic or other food-safe mat'l
Corners: could be single piece with curved or non-curved portions to include spaces for game pieces and/or cards; recommend bottom to avoid grease from pizza; cover optional
Game Board: folded

PIZZA BOX TOY AND GAME DELIVERY DEVICES

This application is a continuation of U.S. patent application Ser. No. 16/542,877, filed on Aug. 16, 2019 which claims the benefit of U.S. Provisional Applications having Ser. No. 62/764,866 filed on Aug. 16, 2018, Ser. No. 62/727,914 filed on Sep. 6, 2018, and Ser. No. 62/821,917 filed Mar. 21, 2019; the contents of which are hereby incorporated by reference in their entirety.

BACKGROUND OF THE INVENTION

It has long been a past-time to entice kids to purchase food by including a prize or toy with the food. Producers of snacks, meals, chewing gum, and drinks have and continue to market their consumable products with prizes and toys. For example, Cracker Jacks® snacks, cereals, McDonald's Happy Meals®, Coca-Cola® beverages, Bazooka Joe® chewing gum, and many other consumable products include the prizes and toys inside packaging of the product, thereby adding to the excitement for children when opening the packages.

As understood, the prizes and toys are not to negatively impact the food. For example, with Bazooka Joe chewing gum, the inside of the gum wrapper has a printed comic. For McDonald's Happy Meals, the toys are typically within plastic bags and placed inside a cardboard box along with food that is typically within separate packaging (e.g., paper or cardboard). Cracker Jacks snacks typically have a small, flat toy that is packaged within paper to keep the toy or prize from getting dirty from the caramel popcorn and peanuts. As most parents can attest, kids tend to like the food that comes with prizes and toys.

One food that most kids like is pizza. The challenge with pizza when it comes to prizes and toys is that pizza is made of melted cheese that is not compatible with anything with which it comes into contact due to the cheese quickly sticking to objects. Pizza is very popular as a delivery food that is delivered in cardboard boxes. The cardboard boxes tend to come in many different styles, and are sized to fit the pizza that is most often round. Pizza boxes are generally 1¾ inches deep to fit a standard pizza, but can range and dimensions depending on the size and style of pizza.

Unlike individual meals for kids, pizza is a sharing food of which families tend to purchase for the entire family to share. Game night is something that families enjoy. Games played by families often include card games, board games, games with dice or popper devices that contain one or more die, game pieces for each player, and so on. In addition to the challenge of maintaining separation of the toys or game elements from contacting the pizza cheese (or other portions of the pizza), board games present additional complexity to deliver within a pizza box due to the size and number of items (e.g., game pieces, dice, cards, and/or game board).

SUMMARY OF THE INVENTION

To achieve the excitement of a prize, toy, or other items (e.g., collectables, board game, etc.) being within a pizza box without having to modify existing pizza boxes, a container or other structure configured to be placed within a corner of a pizza box may be provided. The container may be sized and shaped to enable a small toy, such as a toy animal or character, to fit therein. The container may be covered or uncovered, where an uncovered container may use the top of the pizza box to prevent the toy or price from exiting the container into the pizza box. The container may have a variety of shapes that fit within the corner, and may contact the pizza to prevent movement of the container toward the pizza. In an embodiment, the container may extend from the bottom surface of the pizza box to the top surface in the pizza box, thereby preventing the container or toy from shifting onto the pizza during transit. One or more mechanisms may also be used to prevent movement of the container. If multiple containers are placed within the pizza box, the pizza may be limited from movement within the pizza box, as well.

One embodiment of a delivery pizza may include a pizza box having a top member and a bottom member. The bottom member may include sidewalls and the top member may include flaps that extend into a pizza region defined by the bottom member. A pizza may be disposed within the pizza region of the bottom member. A toy container may be disposed in a gap of the pizza region between the pizza and adjacent sidewalls. A toy may be positioned in the toy container.

One embodiment of a delivery pizza may include a pizza box having a top member and a bottom member. The bottom member may include sidewalls and the top member may include flaps that extend into a pizza region. A pizza may be disposed within the pizza region of the bottom member. A toy partition may be disposed in a gap of the pizza region between the pizza and adjacent sidewalls. A toy may be positioned between the toy partition and adjacent sidewalls.

One method of producing a delivery pizza may include receiving a toy container including toy. A pizza may be placed within a pizza box. The toy container may be placed within a pizza box beside the pizza.

One method of producing a delivery pizza may include receiving a toy retention member. A pizza may be placed within a pizza box. The toy retention member may be placed within a pizza box beside the pizza. A toy may be placed between retention member and sidewalls of a corner of the pizza box.

One embodiment of an in-store pizza assembly may include a pizza tray, a pizza disposed on the pizza tray, and a toy container containing a toy. The toy container may include an extension member that extends beneath the pizza to support the toy container by the pizza tray and the pizza.

One embodiment of a method of assembling an in-store pizza assembly may include placing a pizza on a pizza tray, and placing an extension member of a toy container containing a toy between the pizza and pizza tray to support the toy container thereby.

BRIEF DESCRIPTION OF THE FIGURES

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIGS. 22A-22D (collectively FIG. 22) are illustrations of an illustrative device configured to enable a board game to be delivered within a pizza box; and FIGS. 23A-23D (collectively FIG. 23) are illustrations of an alternative configuration of a device configured to enable a board game to be delivered within a pizza box.

DETAILED DESCRIPTION OF THE INVENTION

Figure 1:
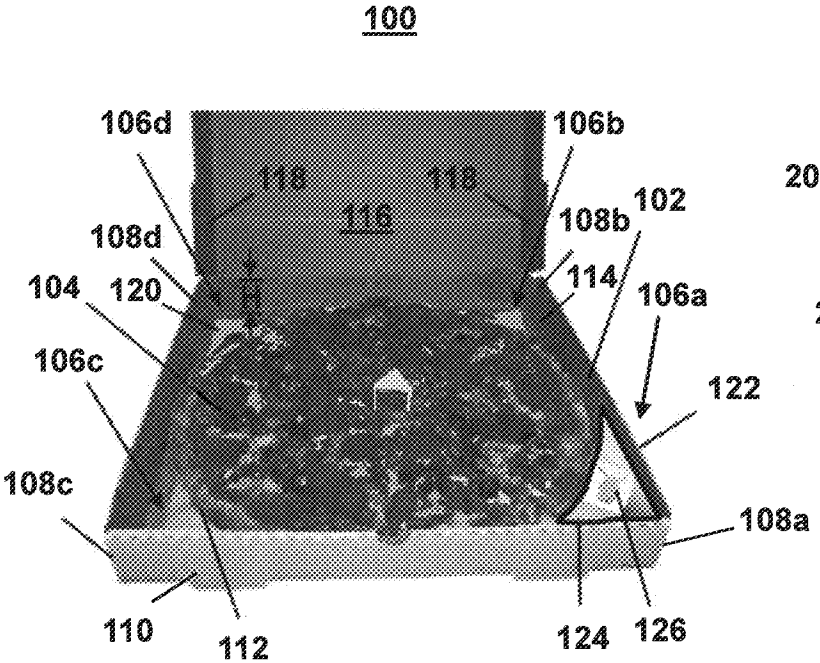
FIG. 1 is an illustration of a typical pizza box inclusive of a typical circular pizza disposed within the pizza box.

With regard to FIG. 1, an illustration of a delivery pizza 100 including a typical pizza box 102 inclusive of a typical circular pizza 104 disposed within the pizza box 102 is shown. The pizza box 102 includes four corners 106*a*-106*d* (collectively 106). Because the pizza 104 is round or circular, gaps 106*a*-106*d* (collectively 106) are formed between each of the corners 108*a*-108*d* (collectively 108) of a bottom member 110 of the pizza box 102 and an outside edge or perimeter 112 of the pizza 104 does not extend into the corners 106 of the pizza box 102. The pizza box 102 includes sidewalls 114 of the bottom member 110, and each of the sidewalls 110 include a top edge 116. The bottom member 110 defines a pizza region within which the pizza 104 is placed. A top member 116 includes flaps 118 that are used to close the top member 116 with the bottom member 110, as understood in the art, to keep the pizza 104 warm. Although not shown, it should be understood that the top member 116 typically includes three flaps, including left, right, and front flaps that are inserted to the inside of the sidewalls 114 of the bottom member 110 so as to hold the top member 116 together with the bottom member 110 using a friction fit. The bottom member 110 defines a height H within the pizza box that extends from a floor 120 to a top edge 122 of the sidewalls 114 of the bottom member 110. As understood in the art, pizza boxes are often 1¾-inches in height, so the height H within the pizza box may be that height. Other heights of pizza boxes may alternatively be used.

As shown, a container 124 that fits into the corner 106*a* between the perimeter 112 of the pizza 104 and sidewall 114 of the pizza box 102. Within the container 124, a toy 126, in this case a Pokemon toy, may be contained. For the purposes of this disclosure, the term "toy" is illustrative, and may be used to represent any other non-food item that may be disposed within a pizza box and/or container. For example, collectables, game pieces, cards, and/or any other item that may be included in the allotted space within the container and/or pizza box may be considered a toy even if the function of the item is not necessarily a toy. The container 124 may be formed of any material, such as cardboard, plastic, or any other material that may have different levels of rigidity. Because the container 124 is positioned in the corner 106*a* that should have relatively little pressure applied thereto from the pizza 104, stiffness of the container 124 should not have too much impact (e.g., not bend the crust) on the pizza 104 itself. The toy 126 should, of course, be able to fit within the container 124. The container 124 has an arc shape that extends along the perimeter 112 of the pizza 104, and the sides along the sidewall 114 of the pizza box 102 are straight. The container 124 may have alternative shapes, as will be shown further herein.

Figure 2:
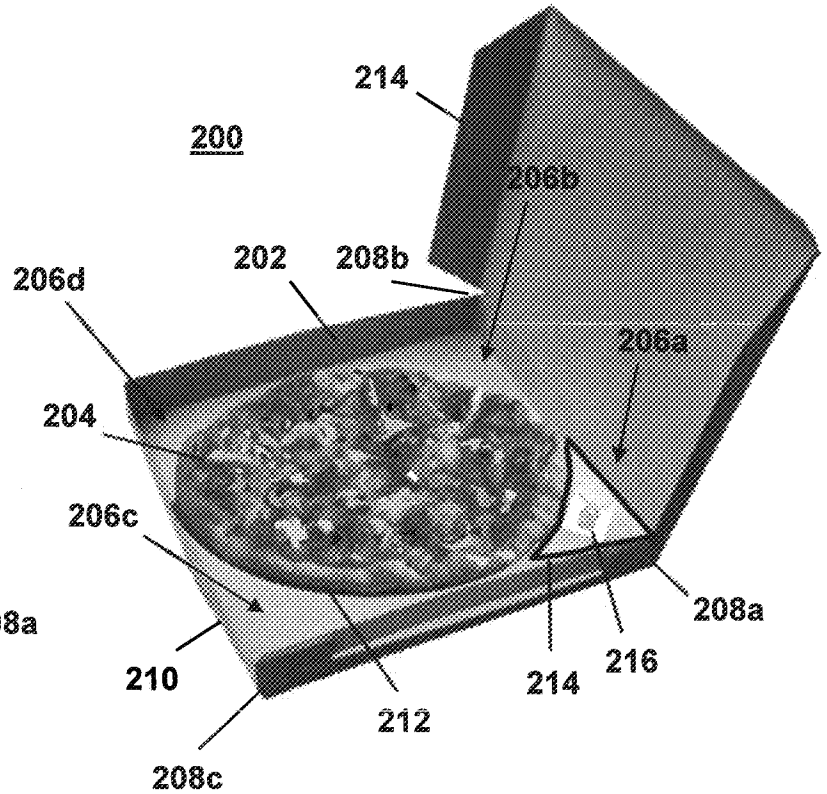
FIG. 2 is an illustration of another typical pizza box shown at another angle and inclusive of a typical circular pizza disposed within the pizza box.

With regard to FIG. 2, an illustration of another delivery pizza 200 with a typical pizza box 202 shown at a different angle from the pizza box 102 of FIG. 1, and inclusive of a typical circular pizza 204 disposed within the pizza box 202 is shown. The pizza box 202 may be a different style from the pizza box 102 of FIG. 1, but has the same basic principles in that gaps 206*a*-206*d* (collectively 206) between corners 208*a*-208*d* (collectively 208) of a bottom member 210 of the pizza box 202 and an outside edge 212 of the pizza 204 are formed. As with FIG. 1, a container 214 with a toy 216 contained therein may be configured to fit within a corner 206*a* between the outside edge 212 of the pizza 204 and inside sidewalls of the pizza box 202.

Figure 3:
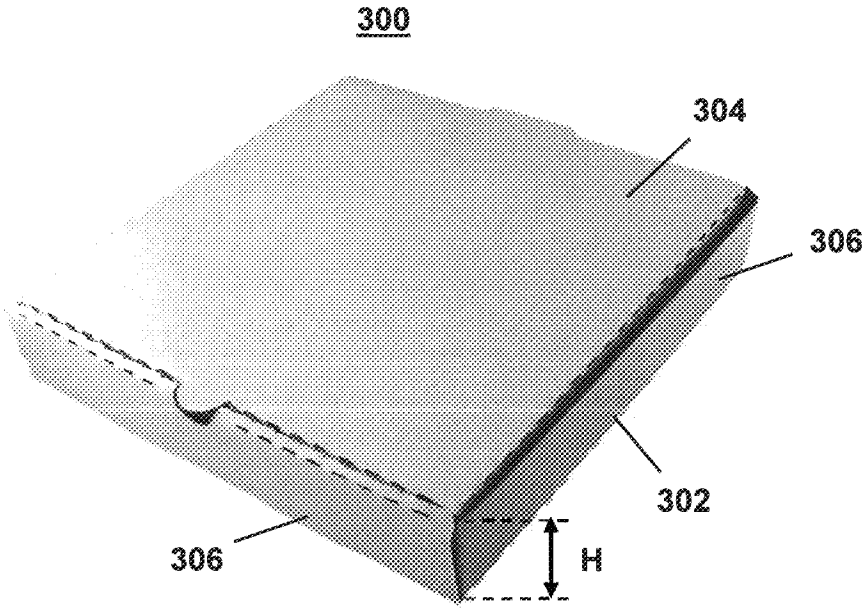
FIG. 3 is an illustration of a closed pizza box having a height.

With regard to FIG. 3, an illustration of a closed pizza box 300 having a height H is shown. The pizza box 300 is conventional, and includes a bottom member 302 and an upper member 304. Flaps (not shown) that extend from the upper member 304 extend downward and are inserted to the inside edge of sidewalls 306, thereby closing a pizza (not shown) within the pizza box 300. The height H defines a height within the pizza box 300, as shown and described with regard to FIG. 1.

Figure 4:
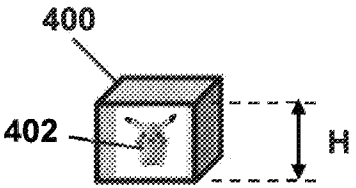
FIG. 4 is an illustration of a toy container configured to be disposed within the pizza box.

With regard to FIG. 4, an illustration of a toy container 400 configured to be disposed within a pizza box, such as pizza box 300 of FIG. 3, is shown. The toy container 400 may be configured to house a toy 402, and have a height H that is equal to or approximately the height of a pizza box, such as pizza box 300. In being approximately equal to, the height of the toy container 400 may be slightly less than the height of the toy container 400 such that the toy container 400 is capable of touching both the top and bottom inside surfaces of the upper and lower members of the pizza box. For example, the toy container 400 may be within a tenth of an inch shorter than the height of the pizza box, thereby touching both the top and bottom of the inside of the pizza box, but and enabling the pizza box to be fully closed. In another embodiment, the height H of the toy container 400 may have a minimum height that is slightly larger than the height of the pizza box minus the height of the pizza crust, thereby preventing the toy container 400 from entering onto the pizza during transit. The toy container 400 may be flexible, semi-rigid, or rigid, where a flexible toy container is easily bent, a semi-rigid toy container is not easily bent, and rigid toy container is more resistant to bending than a semi-rigid toy container. The lateral dimensions of the toy container 400 may be sized as the toy container 400 will be between a top flap of a top member of the pizza box and outside edge of the pizza.

In operation, the toy container 400 may be fully closed so as to encapsulate the toy 402 or have an open top and the top of the pizza box may be used to secure the toy 402 inside the sidewalls and bottom of the pizza box. In another embodiment, the toy container 400 may simply be sidewalls within which a toy is placed, and the toy 402 may be secured within the sidewalls of the toy container 400 and top/bottom of the pizza box. The toy 402 may come complete within a container such that an operator simply places the entire toy container 400 with the toy 402 inside the pizza box. Alternatively, the toy 402 may be separate from the toy container 400, and an operator who packages the pizza within the pizza box may select the toy 402 to place within the toy container 400 when packaging the pizza within the pizza box.

Figure 5:
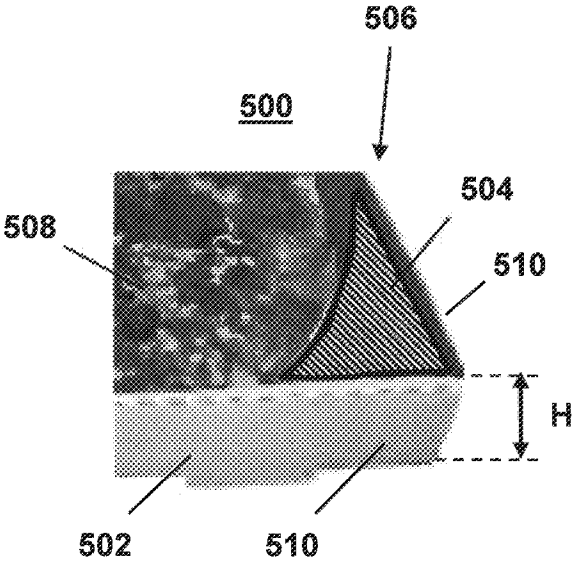
FIG. 5 is an illustration of a corner of a pizza box in which an illustrative toy container may be positioned.

With regard to FIG. 5, an illustration of a corner 500 of a pizza box 502 in which a toy container 504 may be positioned in a gap 506 formed by a pizza 508 and flap of a top member (not shown) that extends to the inside of side walls 510 is shown. The pizza box has a height H defining floor to ceiling height when a top member is closed.

Figure 6A:
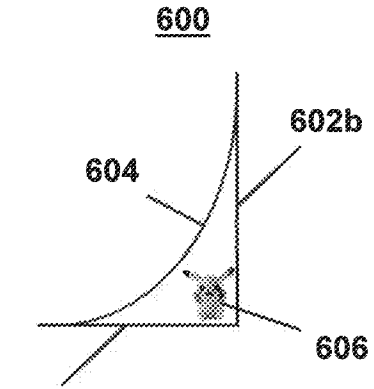
FIGS. 6A and 6B are illustrations of a toy container for positioning in a corner of the pizza box of FIG. 5.
Figure 6B:
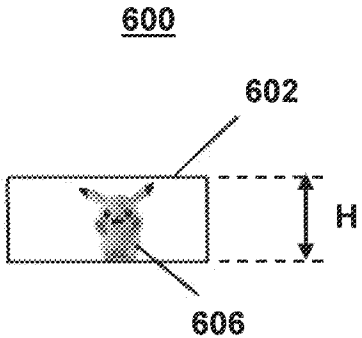

With regard to FIGS. 6A and 6B, top and side view illustrations of a toy container 600 that are configured to be positioning in a gap in a corner of a pizza box, such as the gap 504 of the pizza box 502 of FIG. 5, is shown. The toy container 600 may have a pair of sidewalls 602*a* and 602*b* (collectively 602) and curved wall 604. The curved wall 604 is shown to be an arc, but may take any other shape. In an embodiment, the curved wall 604 may be flexible, such that the pizza may have some ability to press into the toy container 604. In an embodiment, the sidewalls 602 may be cardboard, and the sidewall 604 may be formed of a plastic film that encases a toy 606 within the sidewalls 602 and the plastic film. It should be understood that the materials that are used to form the toy container 600 (or any other toy container described herein) should be heat resistant such that temperatures of pizza do not cause the toy container 600 to melt or negatively interact with the edge of the pizza. As shown in FIG. 6B, the toy 606 has a height of the height H of the toy container 600. In another embodiment, the toy 606 may be horizontal within the toy container 600 such that the toy may be taller than the height H. In such a case, the width of the toy is to be shorter than the height H of the toy container. In an embodiment, the toy container may be compliant, such as a plastic or paper, and the toy 606 may have a height that is higher than the distance between the height of a crust of the pizza and top portion of the pizza box. The toy container 602 has a bottom such that grease from the pizza 508 of FIG. 5 does not get onto the toy 606.

Figure 7:
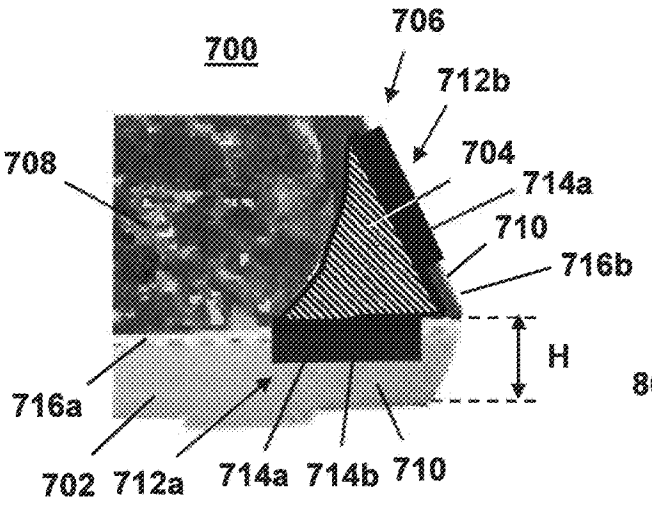
FIG. 7 is an illustration of a corner of a pizza box in which another illustrative toy container is positioned.

With regard to FIG. 7, an illustration of a corner 700 of a pizza box 702 in which a toy container 704 may be positioned in a gap 706 formed by a pizza 708 and flap of a top member (not shown) that extends to the inside of sidewalls 710 is shown. In this case, the toy container 704 is shown to include a pair of flaps 712*a* and 712*b* (collectively 712). including a top portion 714*a* that extends over a top edges 716*a* and 716*b* of the sidewalls 710 and sidewall portion 714*b* that extends downward along the sidewall 710. By having the two flaps 712, the container 704 may be secured in position. It should be understood that the flaps 712 are illustrative, and in an alternative embodiment, rather than bringing the flaps up and over the top portion 716, the flap may come upwards along the sidewall such that the flaps of the top member of the pizza box hold down the toy container 704 by the flap that is pinched beneath and to the side of the flaps from the top member and bottom member 702.

Figure 8A:
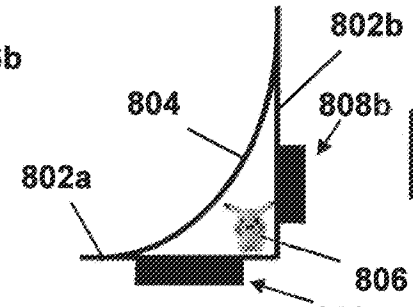
FIGS. 8A and 8B are illustrations of an illustrative toy container for positioning in a corner of the pizza box of FIG. 7.
Figure 8B:
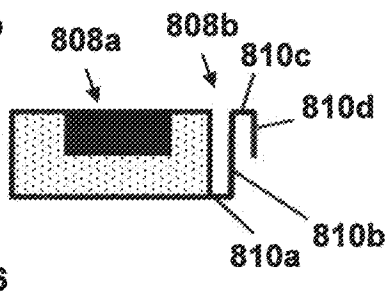

With regard to FIGS. 8A and 8B, top and side view illustrations of an illustrative toy container 800 for positioning in a corner of the pizza box of FIG. 7 are shown. The toy container 800 is shown to include sidewalls 802*a* and 802*b* along with curved sidewall 804. A toy 806 is disposed within the toy container 800. The toy container 804 may include bottom and top walls (not specifically identified, as well. Flaps 808*a* and 808*b* (collectively 808) are shown to include four portions, including (i) a bottom portion 810*a*, (ii) inside portion 810*b*, (iii) top portion 810*c*, and (iv) outside portion 810*d*. As previously described, rather than including four elements of the flaps 808, the flaps may be limited to two elements, bottom portion 810*a* and inside portion 810*b* so as to be easier to fabricate and install in the pizza box. The flaps may be flexible, such as being formed out of thin cardboard. Alternatively, the flaps may be more rigid, such as being made out of a plastic that is stiffer than cardboard. Any other material may be used for the walls 802/804 and flaps 808 of the toy container 800. The material may provide some level of head shield such that heat from the pizza does not negatively impact the material of the toy.

Figure 9:
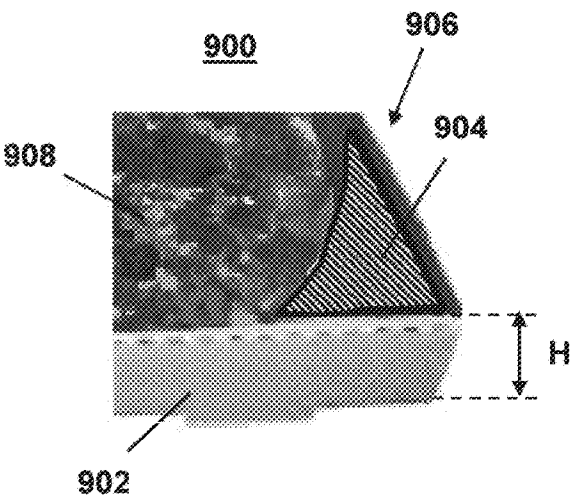
FIG. 9 is an illustration of a corner of a pizza box in which another illustrative toy container is positioned.

With regard to FIG. 9, an illustration of a corner 900 of a pizza box 902 in which another illustrative toy container 904 is positioned is shown. In this case, rather than using flaps to secure the toy container 904 in the pizza box to minimize movement, extenders (see FIGS. 10A and 10B) that extend from the bottom of the toy container 904 under the pizza 908 may be used.

Figure 10A:
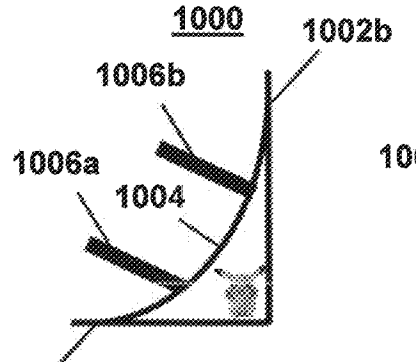
FIGS. 10A and 10B are illustrations of an illustrative toy container for positioning in a corner of the pizza box of FIG. 9.
Figure 10B:
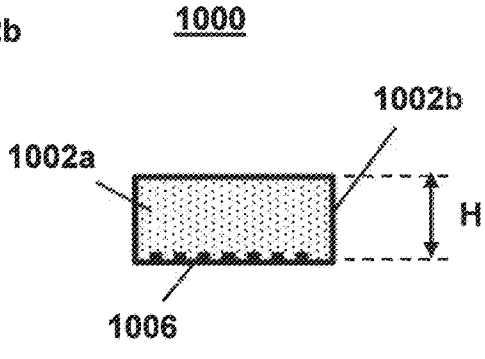

With regard to FIGS. 10A and 10B, illustrations of an illustrative toy container 1000 for positioning in a corner of the pizza box of FIG. 9 are shown. The toy container 1000 includes sidewalls 1002*a*, 1002*b*, and 1004. Extenders 1006*a* and 1006*b* (collectively 1006) may extend diagonally from the wall 1004 (or from the bottom of the toy container 1000) to extend beneath the pizza so as to maintain the toy container 1000 in position relative to the pizza. The extenders 1006 may extend a sufficient distance (e.g., ½-inch, 1-inch, 1-½-inch or otherwise) beneath the pizza to prevent the toy container 1000 from tipping onto the pizza. The extenders 1006 may be stiff enough to prevent enough bending that the toy container 1000 from tipping onto the pizza. Moreover, the extenders 1006 may hold the pizza from pushing into the corner in which the toy container 1000 is positioned.

Figure 11:
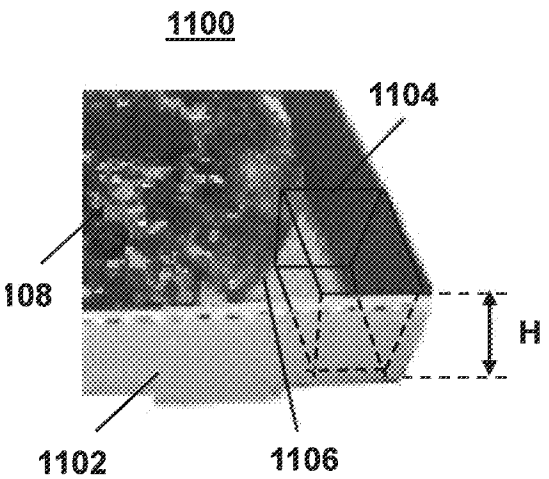
FIG. 11 is an illustration of a corner of a pizza box in which another illustrative toy container is positioned.

With regard to FIG. 11, an illustration of a corner 1100 of a pizza box 1102 in which another illustrative toy container 1104 is positioned (frame only) is shown. The toy container 1104 is shown to be a rectangular box in this case. The height of the toy container 1104 may have a height H that is substantially the same as the height of the inside of the pizza box (e.g., within a few millimeters of the height of the inside of the pizza box). In this case, the corner of the toy container 1104 may press against an edge 1106 of a pizza 1108.

Figure 12B:
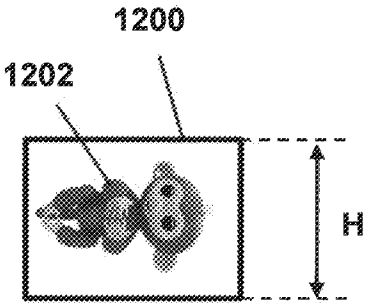
FIGS. 12A and 12B are illustrations of an illustrative toy container for positioning in a corner of the pizza box of FIG. 11.
Figure 12A:
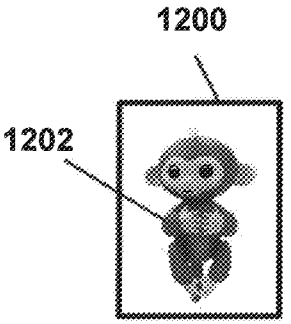

With regard to FIGS. 12A and 12B, illustrations of an illustrative toy container 1200 for positioning in a corner of the pizza box of FIG. 11 are shown. The toy container 1200 may be a rectangular box that is sized (length, width, and height) large enough to contain a toy 1202. As previously described, the toy container 1200 should be shaped to prevent the toy container 1200 from being able to contact cheese or otherwise be able to be moved over the crust during motion of the pizza box or pizza so as to avoid contacting the cheese on the pizza.

Figure 12E:
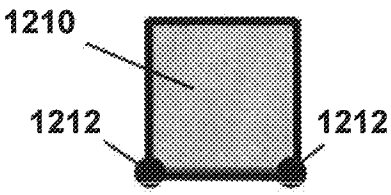
FIGS. 12D and 12E is an alternative embodiment for positioning the toy within a pizza box.
Figure 12D:
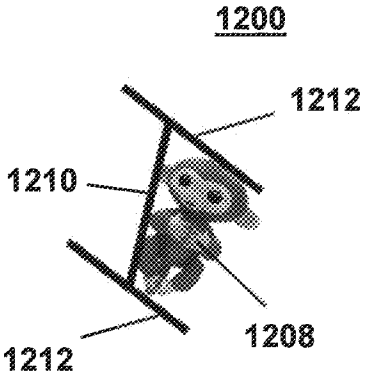
Figure 12C:
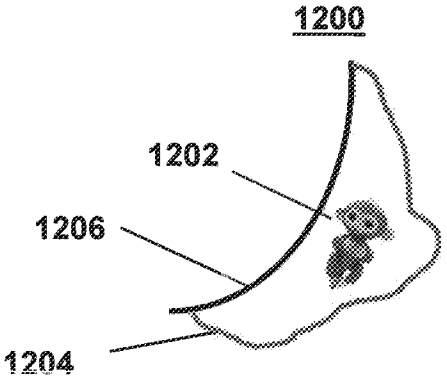
FIG. 12C is an alternative embodiment that includes a plastic or other pliable material (e.g., cellophane or other clear plastic material) that may enclose a toy.

As shown in FIG. 12C, in an alternative embodiment, rather than using a toy container, such as toy container 1104 or 1200, a plastic or other pliable material 1204 (e.g., cellophane or other clear plastic material) may enclose the toy 1202. To prevent the toy or the pliable material 1204 from touching the cheese, the pliable material 1204 may be attached to a partition wall 1206. In this case, the partition wall 1206 is shaped as an arc so as to similarly match the outside edge of the pizza. Support member(s) (see, for example, FIGS. 16B and 16D) may be attached to the partition wall 1206 to help prevent the toy 1202 from rotating during transit or other movement of the pizza box.

With regard to FIGS. 12D and 12E, an alternative embodiment for positioning the toy 1202 within a pizza box is shown. In this embodiment, rather than using a container per se, the toy 1202 is attached to one or more wall members 1210, which may include or be attached to leg members 1212 during production or after production of the toy, thereby avoiding having to include a separate container. As described herein, the legs 1212 may be used to prevent rotation of the toy 1208 and wall member(s) 1210. In an embodiment, plastic or other material may enclose the toy 1208 and wall member(s) 1210, and, optionally, legs 1212. In an alternative embodiment, rather than using legs, a floor and/or extension member that is flat and is capable of extending under the pizza may be utilized, as further shown herein. Other configurations that use one or more structural features described herein may be utilized, as well.

Figure 13:
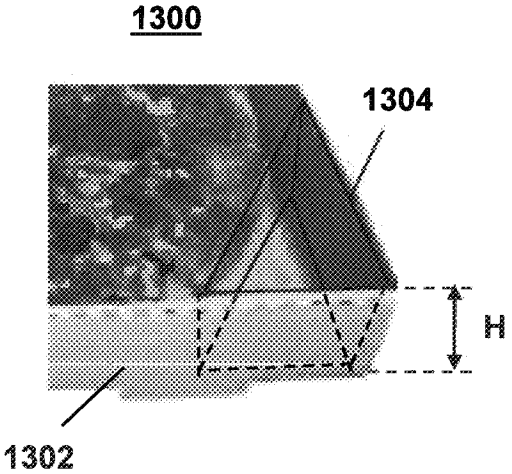
FIG. 13 is an illustration of a corner of a pizza box in which another illustrative toy container is positioned.

With regard to FIG. 13, an illustration of a corner 1300 of a pizza box 1302 in which another illustrative toy container 1304 is positioned is shown. The toy container 1304 in this embodiment is a right triangular-shaped container. Although not shown, the toy container 1304 may include flaps or extenders as previously shown with regard to FIGS. 8 and 10.

Figure 14B:
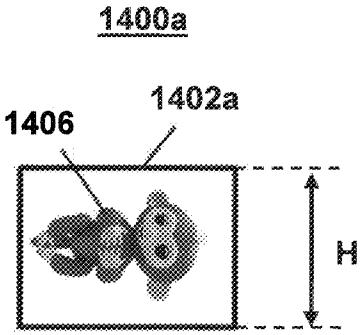
FIGS. 14A and 14B are illustrations of an illustrative toy container for positioning in a corner of the pizza box of FIG. 13.
Figure 14A:
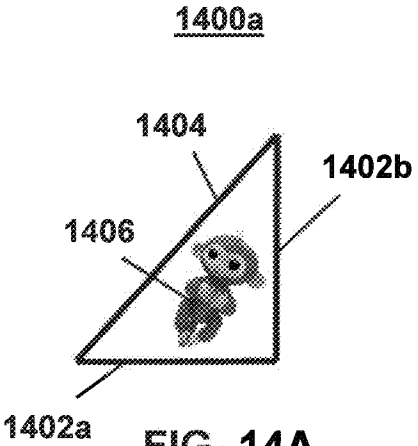

With regard to FIGS. 14A and 14B, illustrations of an illustrative toy container 1400*a* for positioning in a corner of the pizza box of FIG. 13 are shown. In this case, the toy container 1400*a* is triangular (e.g., right triangle) such that the toy container 1400*a* may be positioned in the corner. The toy container is shown to include two leg edges 1402*a* and 1402*b* (collectively 1402) of the triangle and a hypotenuse edge 1404 that extends between the two leg edges 1402. A space defined by the leg edges 1402 and hypotenuse edge 1404 is shown to be sufficiently large for a toy 1406 to be stored in the toy container 1400*a*.

Figure 14C:
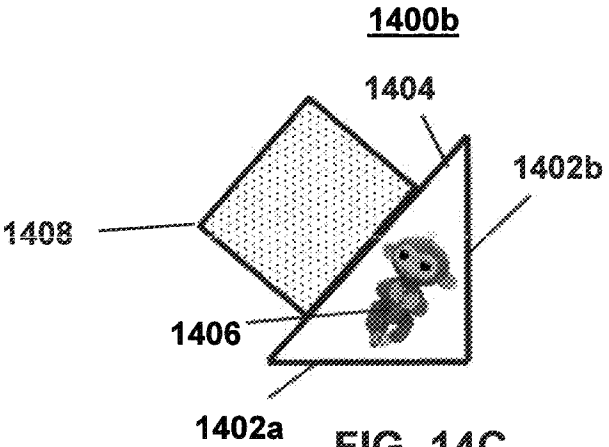
FIG. 14C is an illustration of an alternative configuration of the toy container of FIGS. 14A and 14B that includes an extension member that extends beneath a pizza slice to help maintain the toy box in a stationary position relative to the pizza.

With regard to FIG. 14C, an illustration of an alternative toy container 1400*b* that includes an extension member 1408 that extends from the hypotenuse edge 1404 beneath a pizza slice to help maintain the toy box in a stationary position relative to the pizza is shown. In this embodiment, the extension member 1408 may be formed of the same material as the other portions of the toy container 1400*b*. For example, the toy container may be formed of cardboard and the extension member 1408 may be a portion of the cardboard cut to extend outwards from the hypotenuse edge 1404. That is, if the toy container 1400*b* is cut from a flat piece of cardboard and folded and assembled to form the toy container portion 1400*a* with the extension member 1408 not being folded, then a sufficient stiffness of the extension member 1408 may be capable of performing the desired function. To assemble the toy containers 1400*a* and 1400*b*, scoring of the material to show where to bend the sides along with slots and insertion members that are often used to assemble and hold together a cardboard or other material container may be utilized. Although the toy containers 1400*a* and 1400*b* are shown to be triangular with the extension member 1408 being rectangular, it should be understood that alternative shapes may be utilized, as well.

Figure 15:
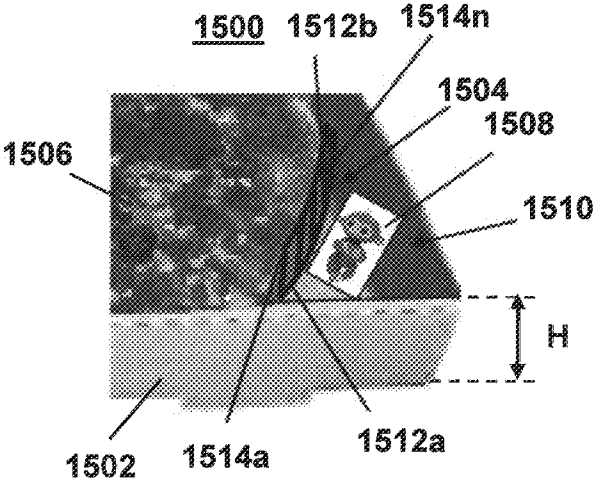
FIG. 15 is an illustration of a corner of a pizza box in which an illustrative toy partition is positioned.

With regard to FIG. 15, an illustration of a corner 1500 of a pizza box 1502 in which an illustrative toy partition 1504 is positioned is shown. The toy partition 1504 is shown to be curved such that the toy partition 1504 follows along an edge or crust of a round pizza 1506. A toy or container with a toy 1508 may be disposed in a gap 1510 between the toy partition 1504 and side walls of the pizza box 1502. The toy partition 1504 may include lower and upper members 1512*a* and 1512*b* (collectively 1512), and connector members 1514*a*-1514*n* (collectively 1514) may span between the members 1512. It should be understood that the configuration of the toy partition 1504 is illustrative, and that a variety of alternative configurations may be utilized. For example, rather than having connector members 1514, a solid member extending between upper and lower members 1512 may be utilized. By using connector members 1514, less material may be utilized to produce the toy partition 1504. Rather than being curved, a straight or diagonal shape may be utilized.

Figure 16A:
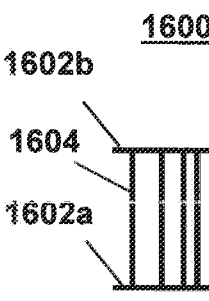
FIGS. 16A and 16B are illustrations of an illustrative toy partition for partitioning a toy from a pizza in a corner of the pizza box of FIG. 15.
Figure 16B:
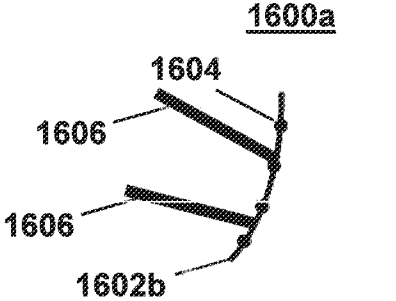

With regard to FIGS. 16A and 16B, illustrations of an illustrative toy partition 1600*a* for partitioning a toy from a pizza in a corner of the pizza box of FIG. 15 are shown. As shown in FIG. 16A, the toy partition 1600*a* is curved, so the side view of the toy partition 1600*a* makes lower and upper members 1602*a* and 1602*b* look short, and connector members 1604 appear to have different spacings therebetween. In FIG. 16B, the connector members 1604 are shown to be regularly spaced. Extender members 1606 extend from the lower member 1602*a* so as to be positioned beneath the pizza to help prevent the toy partition 1600*a* from tipping over either toward or away from the pizza. Although the extender members 1606 are shown to extend in one direction, it should be understood that the extender members 1606 may be configured to extend both directions from the lower member 1602*a*, thereby providing additional support. Although the connector members 1604 are vertical, it should be understood that any other shape (e.g., diagonal, crossing, in the shape of a logo, etc.) may be utilized.

Figure 16C:
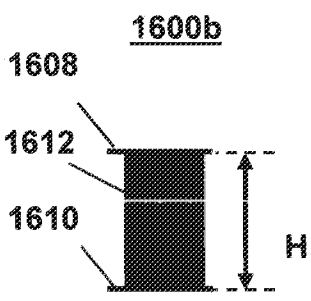
FIGS. 16C and 16D are illustrations of an alternative embodiment to the toy partition of FIGS. 16A and 16B by including a solid wall.
Figure 16D:
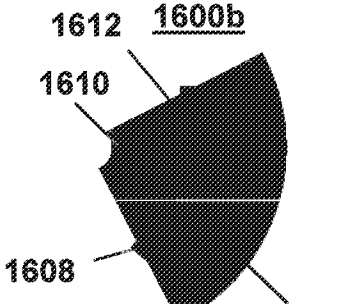

As shown in FIGS. 16C and 16D, and as an alternative embodiment to the toy partition 1600*a* of FIGS. 16A and 16B, toy partition 1600*b* is shown to include an upper member 1608, floor member 1610, and solid wall 1612, each formed of the same or different material (e.g., cardboard or plastic) and of a single or multiple components. The floor member 1610 is connected to the bottom of the wall 1612. In this embodiment, the use of the floor member 1610 functions to separate a toy or package in which the toy is contained from any grease or other food debris that is in the corner of the pizza box. Moreover, the use of the solid wall 1612 fully separates the toy or packaging surrounding the toy from contacting the pizza. It should be understood that alternative embodiments of the wall 1612 may be utilized, such as a bottom portion of the wall 1612 being solid and an upper portion of the wall having connector members similar to or different from those of the partition 1600*a*. In an embodiment, the toy partition 1600*b* and/or wall 1612 may be made of a material that is food friendly (i.e., complies with government standards) and may be used to reduce heat from impacting the toy.

Figure 17B:
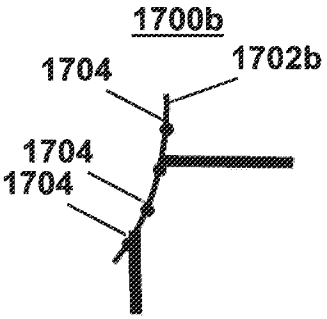
FIGS. 17A and 17B, illustrations of another illustrative toy partition for partitioning a toy from a pizza in a corner of the pizza box of FIG. 15.
Figure 17A:
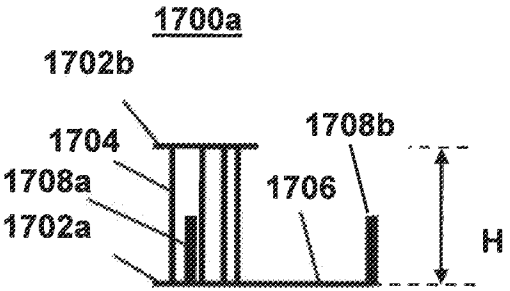

With regard to FIGS. 17A and 17B, illustrations of another illustrative toy partition 1700 for partitioning a toy from a pizza in a corner of the pizza box of FIG. 15 are shown. In this embodiment, the toy partition 1700 includes lower and upper members 1702*a* and 1702*b* along with connector members 1704. Two base extender members 1706*a* and 1706*b* (collectively 1706) may extend from the lower member 1702*a* to connect to retention members 1708*a* and 1708*b* (collectively 1708), which are meant to be positioned between flaps of a top member of a pizza box and sidewall of a bottom member of the pizza box. It should be understood that one or more extender members and retention members may be utilized, and that shape, including length, width, height, thickness, etc., may be established to support specific types of pizza boxes and size of pizzas relative to the size of the pizza box. In an embodiment, the retention members 1708 have a height that is ½ the height of the connector members 1704. Alternative heights of the retention members may be utilized. By using two or more extender and retention members 1706 and 1708, the toy partition 1700 may provide for a balanced and stable toy partition 1700 to prevent the pizza from pushing the toy partition 1700 over.

Figure 18:
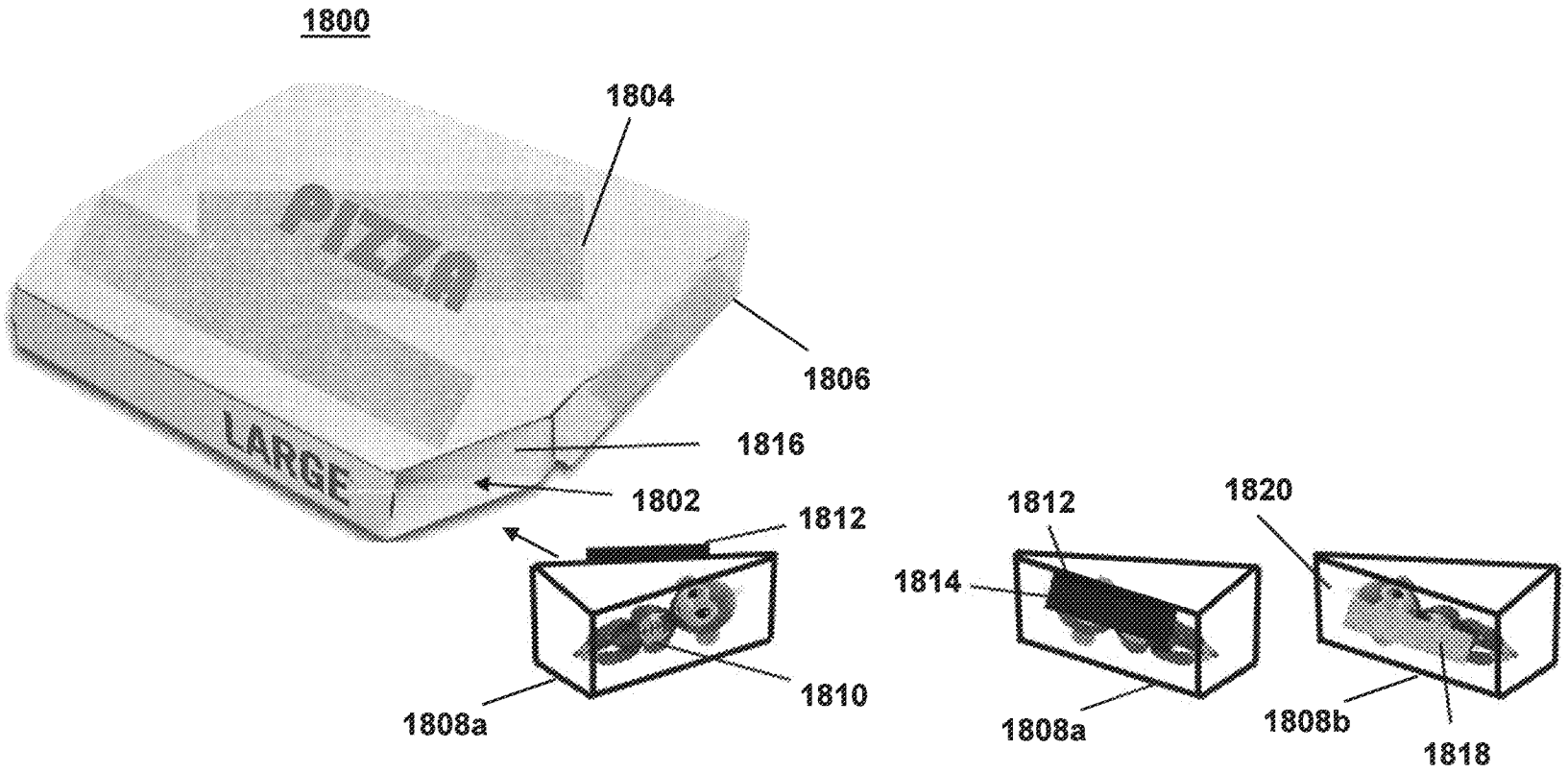
FIG. 18 is an illustration of an illustrative pizza box that defines a corner region between top and bottom members within which a toy container may be positioned.

With regard to FIG. 18, an illustration of an illustrative pizza box 1800 that defines a corner region 1802 between a top member 1804 and bottom member 1806 within which illustrative toy containers 1808*a* and 1808*b* may be positioned is shown. The toy container 1808*a* is shown to be in the shape of a wedge that substantially matches the corner region 1802. It should be understood that the toy containers 1808*a* and 1808*b* do not need to be a perfect match for the corner region 1802, but rather be configured to fit within the corner region 1802 in a manner that enables the toy containers 1808*a* and 1808*b* to be retained therein. A toy 1810 may be disposed within the toy containers 1808*a* and 1808*b*.

To maintain the toy containers 1808*a* and 1808*b* within the corner region 1802, two illustrative options are shown, including the use of a flap 1812 that may have an extended portion 1814 to hold the toy container 1808*a* within the corner region 1802 by the flap being sandwiched between the top member 1804 and a sidewall 1816 of the bottom member 1806. Rather than using a flap, an adhesive strip 1818 may be disposed along a wall 1820 that contacts the sidewall 1816. It should be understood that a variety of alternative features that are capable of maintaining the toy containers 1808*a* and 1808*b* within the corner region 1802 may be utilized in accordance with the principles described herein. Because a child of a customer is intended and expected to access the toy 1810, the feature(s) that maintain the toy container in the corner region 1802 should be easily releasable from the pizza box 1800. Alternatively, the toy containers 1808*a* and 1808*b* may be configured to be easily opened by a child. In an alternative embodiment, rather than having a fully closed container, a portion of a container or barrier that is configured to be held to the box and prevent a toy or other prize from exiting the corner region 1802 may be utilized. For example, clips, extenders, adhesives, or other mechanism used to removably connect a container to limit movement from the pizza box 1800 may be utilized.

Figure 19:
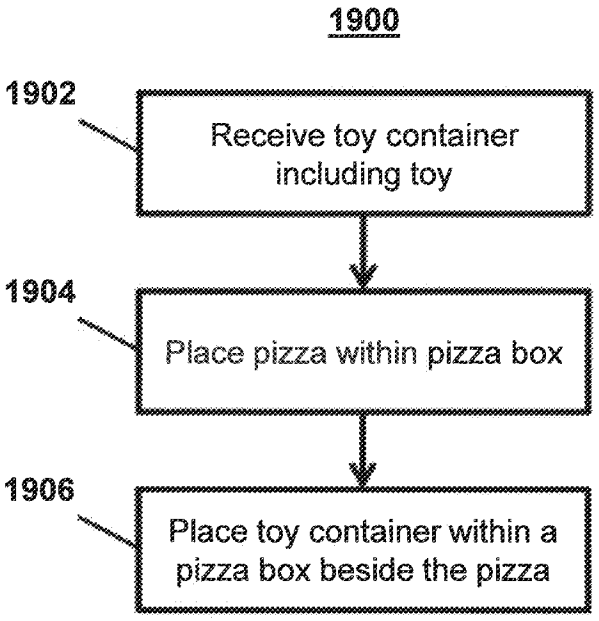
FIG. 19 is an illustrative process of installing a toy in a pizza box.

With regard to FIG. 19, an illustrative process 1900 of installing a toy in a pizza box is shown. The process 1900 may start at step 1902, where a toy container including a toy may be received. At step 1904, a pizza may be placed inside a pizza box. At step 1906, the toy container may be placed within the pizza box beside the pizza. In an embodiment, steps 1904 and 1906 may be reversed. In an embodiment, the toy container may not initially include a toy, but rather a toy may be placed inside the toy container after the toy container is placed inside the pizza box.

Figure 20:
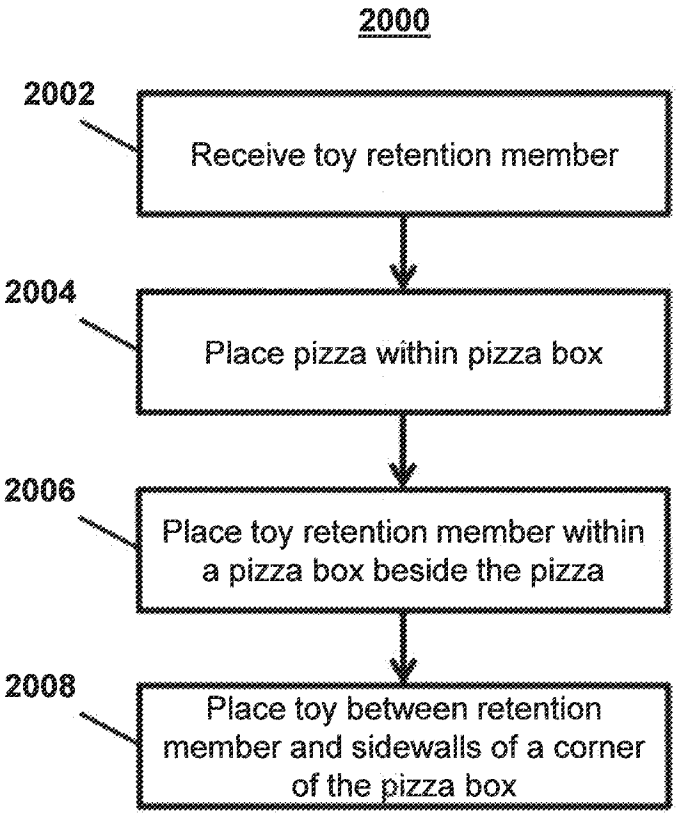
FIG. 20 is an illustrative process of installing a toy in a pizza box.

With regard to FIG. 20, an illustrative process 2000 of installing a toy in a pizza box is shown. The process 2000 may start at step 2002, where a toy retention member may be received. At step 2004, a pizza may be placed inside a pizza box. At step 2006, the toy retention member may be placed within the pizza box beside the pizza. Steps 2004 and 2006 may be reversed. In an embodiment, a toy may be placed between the toy retention member and the sides of the pizza box. Depending on the configuration of the toy retention member, extender members may be extended under the pizza or retention members may be placed between a top flap and side walls of the pizza box, as previously described. In yet another embodiment, if the pizza box has a beveled corner, but does not include upper and lower members surrounding a gap, then the toy container may be configured to fit along a diagonal portion. The container may be shaped as a triangular corner member (e.g., to extend that a full corner is defined by the container), and may be configured with a connecting or hanging member, such as previously shown to extend down along an inner sidewall of the pizza box to secure the toy container. In an embodiment, for any of the embodiments described herein, an adhesive strip may be placed on the bottom and/or side of the container to enable the container to be temporarily adhered to the inside or outside of the pizza box, thereby allowing for a more simple container that does not need connection or retention members.

Figure 21:
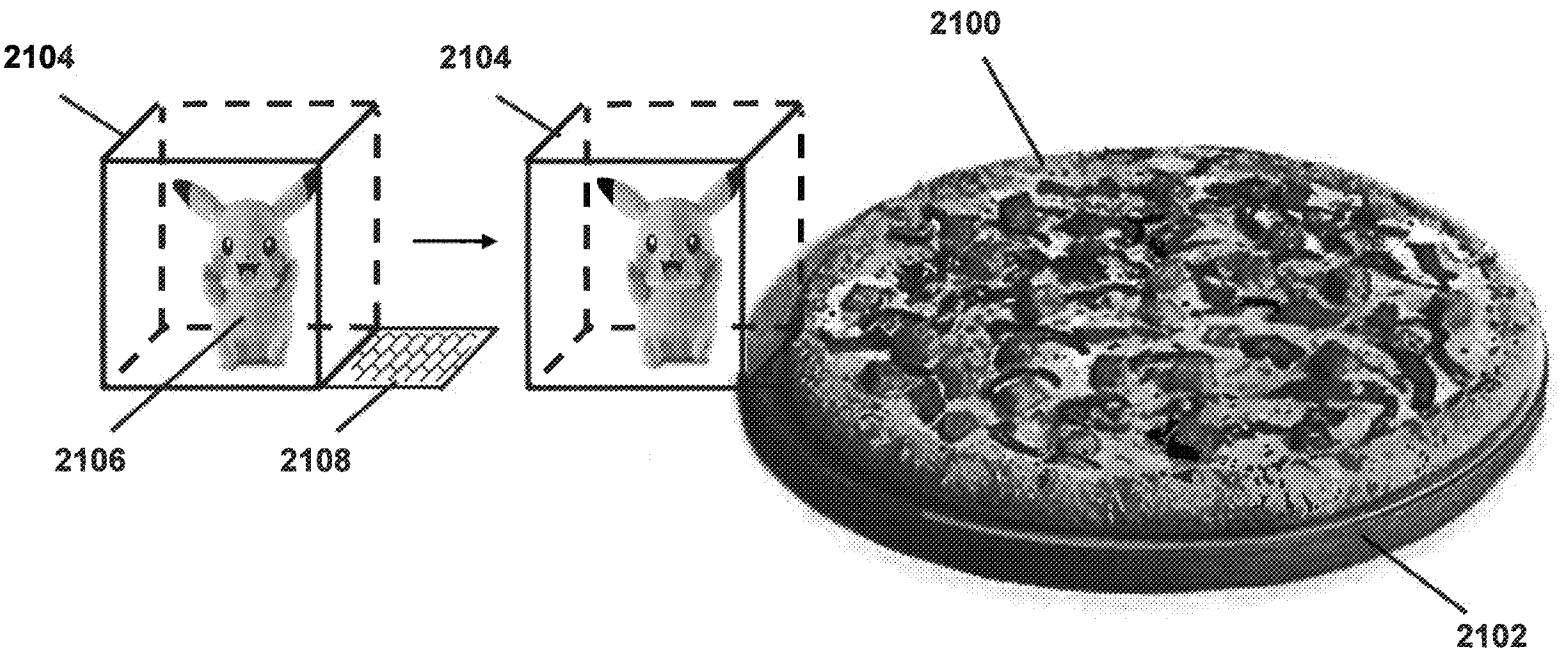
FIG. 21 is an illustration of an illustrative pizza served on a tray that includes a toy container with a prize or toy contained therein that is shown to be slid between the pizza and the tray.

With regard to FIG. 21, an illustration of an illustrative in-store pizza assembly 2100 that includes a pizza 2101 served on a tray 2102 may include a toy container 2104 with a prize or toy 2106 contained therein. In this embodiment, the toy container 2104 includes an extension member 2108 that extends from a bottom portion 2108 of the toy container 2104. As shown, the toy container 2104 is shown to be slid between the pizza 2101 and the tray 2102. One embodiment of a method of assembling the in-store pizza assembly 2100 may include placing the pizza 2101 on the pizza tray 2102, and placing the extension member 2108 of the toy container 2104 containing the toy 2106 between the pizza 2101 and pizza tray 2102 to support the toy 2106 container thereby. Although only a single toy container 2104 is shown, it should be understood that up to eight or more toy containers 2104 may be provided. For example, in the case of a family having three kids, three toys in toy containers may be provided in the same or similar manner as that shown.

It should be understood that alternative shapes and configurations of the toy container 2104 and/or extension member 2108 may be utilized. For example, any of the features of the toy containers shown and described herein that provides for positioning and supporting the toy container 2104 between the pizza 2101 and tray 2102 may be used for the tray-served pizza. The extension member 2108 may also be configured (e.g., shape, thickness, compliance factor) such that the portion of the toy container 2104 containing the toy does not bend over and hang downwards from the edge of the tray 2102. Moreover, to prevent grease or other food getting on the toy 2106, the toy container 2104 may be formed of and/or coated with a material that resists absorbing grease or other liquid for at least a period of time that is sufficient for the pizza 2101 to be served to a customer at a restaurant. The toy container 2104 may be designed to also be suitable for a pizza box, thereby saving cost of manufacturing, shipping, storage, and in-store operations.

Still yet, if either or both the pizza 2101 and tray 2102 has a different configuration than that being shown, the toy container 2104 and/or extension member 2108 may be configured to fit between the alternatively shaped pizza 2101 and/or extension member 2108. In an embodiment, the toy container 2104 is formed of an opaque or translucent material (e.g., cardboard, plastic, etc.) such that the toy 2106 may not be seen or clearly seen. In an alternative embodiment, rather than the toy container 2104 having an extension member, an attachment member that is separate and attachable or can otherwise support the toy container in the same or similar manner as the extension member 2108 may be utilized. Although not particularly practical, the toy container or an independent component may be configured to clip to the pizza tray to provide a similar function of supporting the toy with the in-store pizza assembly 2100.

By serving the toy 2106 in the toy container 2104, a recipient (e.g., child) may be surprised by the toy or prize 2106 when the pizza is served and opened.

In general, one embodiment of an in-store pizza assembly may include a pizza tray, a pizza disposed on the pizza tray, and a toy container containing a toy. The toy container may include an extension member that extends beneath the pizza to support the toy container by the pizza tray and the pizza.

With regard to FIG. 22, an illustration of an illustrative integrated pizza box 2200*a* configured that includes a pizza box 2201 having a board game delivery device or mechanism 2202 that includes one or more frame members 2203*a*-2203*b* (collectively 2203), where outside frame members 2203*a* are configured to extend along an inside wall of the pizza box 2201 and the inside frame members 2203*b* have a semi-circular shape that defines a side opposing the outside frame numbers 2303. Storage regions 2204*a*-2204*b* (collectively 2204) may be formed between the inside frame members 2203*b* and outside frame members 2203*a*. It should be understood that the storage regions may have any shape as defined by the integrated shape of the frame members 2203. In other words, the frame members 2203 are illustrative, and any other shapes may be utilized to form the storage regions 2204. Board game accessories, such as game pieces, cards, die, dice, timer, and/or other items used to play the board game may be disposed in the storage region(s) 2204.

In an embodiment, and as previously shown, the storage regions 2204 may include one or more corners of the pizza box 2201. Moreover, within each of the storage regions 2204, multiple compartments (not shown) may be formed as defined by structure and shape of the frame members 2203. In an embodiment, the outside frame members 2303 may connect along a wall 2206 of the pizza box 2201 such that only a single board game delivery device mechanism 2202 may be included in the pizza box 2201 that encompasses both corners of the pizza box 2201 for storage regions 2204. It should be understood that the frame members 2303 may encompass the entire box such that each of the two additional vacant corners of the pizza box 2201 are also utilized. That is, storage regions may be formed in one or more of the corners of the pizza box 2302 in which pizza does not extend, and where extra space exists for the board game delivery device 2202. If, for example, a pizza box has portions in which the corners (e.g., front corners) are unavailable, then the board game delivery device 2202 may be designed with one or two of the regions 2204 defined by the frame members 2303.

A game board protector 2208 or game board itself 2208' may be disposed on a bottom, inside surface of the pizza box 2201. The game board protector 2208 or game board 2208' may be attached to or integrated with the frame members 2303 so that the game board protector 2208 or game board 2208' and frame members may be placed within the pizza box 2201 in a single motion (i.e., slide the game board delivery device 2202 onto the bottom, inside portion the pizza box 2201). A pizza 2210 may be placed on top of the game board protector 2208 or game board 2208' either directly or a piece of conventional paper that is often placed in pizza boxes may be placed between the pizza 2210 in the game board protector 2208 or a game board 2208' to limit exposure of the pizza 2210 to the game board protector 2208 or game board 2208', which also reduces oil from the pizza from contacting the game board protector 2208 or game board 2208'.

Within each of the storage regions 2204, game pieces 2212*a*-2212*n* (collectively 2212) and playing cards 2214 may be disposed. It should be understood that other board game elements or accessories, such as dice, die, die/dice popper, and/or otherwise may also be stored within the storage regions 2204. If the other two corners have storage regions defined by the frame members 2203, then additional items for use with the board game 2202 may be stored therein, as well.

In an embodiment, the storage regions 2204 may be pre-populated with board game accessories, thereby allowing for a worker to place or insert the board game delivery mechanism 2202 within the pizza box 2201 in a single step without having to separately add the board game accessories. Alternatively, the board game accessories may be separately added to the storage regions 2204 at a pizza store as opposed to a manufacturing or other facility prior to be delivered to a pizza store.

With regard to FIG. 22B, a side view of the board game delivery mechanism 2202 is shown. The outside and inside frame members 2203*a* and 2203*b* may be connected or otherwise adhered to the game board protector 2208 or a game board 2208'. The game pieces 2212 and cards 2214 are shown to be located within the storage areas 2204. In an embodiment, the board game protector 2208 or game board 2208' has a length L and a width W. It should be understood that although the game board protector 2208 or game board 2208' is shown to be nearly the full dimensions of the bottom surface of the pizza box 2201, the dimensions of the game board protector 2208 or game board 2208' may have different dimensions, such as shown in FIG. 23.

With regard to FIG. 22C, a zoomed-in illustration of a game board protector 2208 is shown. The game board protector 2208 may be configured to store a game board 2216 that may be inserted and optionally removed within an opening 2218 and located on an end of the game board protector 2208. The game board protector 2208 is defined by top and bottom surfaces 2220*a* and 2220*b*. The game board 2216 may, therefore, be protected by the game board protector 2208 so as to avoid having grease other food contaminants contact the game board 2216. The top and bottom surfaces 2220 of the game board protector 2208 may be made of any food-safe material, such as plastic, that meets compliance with health safety rules of any country in which the device 2202 is utilized. The opening 2218 may be sized and shaped to enable the game board 2216 to slide therein. In an embodiment, a flap or other mechanism may form a seal such that food is unable to enter within the top and bottom surfaces 2220 of the game board protector 2208. As shown, the game board protector 2208 including the game board 2216 has a height of H2. In an embodiment, the game board protector 2208 may be pre-populated with the game board 2216. And, if the storage region(s) 2204 are pre-populated with board game accessories (e.g., game pieces, dice, cards, etc.), a worker may simply place the board game delivery device mechanism 2202 into the pizza box 2201 in a single step. Alternatively, the board game delivery device mechanism 2202 may not be pre-populated, and a worker may populate the board game delivery device mechanism 2202 when producing the delivery pizza.

With regard to FIG. 22D, an illustration of an illustrative game board 2208' is shown. In this embodiment, the game board 2208' may have the same material as the top and bottom surfaces 2220 of the game board protector 2208 of FIG. 22C. In this embodiment, rather than having an opening 2218, the game board 2208' may have ink printing of a game board directly on the material of the game board 2208'. For example, the printing may be on top, bottom, and/or inside the game board 2208'. The printing may define spaces or other representations that are typically on a game board, such as conventional game boards, as understood in the art. In the event that the printing is on top, then a food-safe coating may be disposed on top of the printing to reduce or eliminate the ability for ink to be transferred from the game board 2208' onto food with which the game board 2208' comes in contact. The coating may also help reduce or eliminate the ability for grease or other food substances to remove or damage the printing. If the printing is within the material of the game board 2208', Then the game board 2208' may be formed of a bottom layer and a top layer, and the printing may be performed on the bottom layer and the top layer of may be transparent or otherwise translucent at least in certain areas such that a player may be able to see the printing of the board itself. If the printing is on the bottom of the material that forms the game board 2208', then a coating, such as described with regard to the top layer, may be disposed on top of the printing to limit damage to the ink printed thereon.

It should be understood that the printing may also be performed on paper, and that the material of the game board 2208' may be more of a lamination, where the paper is contained within a top and bottom layer of lamination material that is food-safe. The height of the game board 2208' may be H2', which may be the same or different height as the game board protector 2208 height H2. In an embodiment, whether the device 2208 is formed of a game board protector 2208 or game board 2208', the dimensions may account for being beneath the storage regions 2204, such that grease or other food particles do not contact the game pieces 2212 or cards 2214, for example. In an alternative embodiment, the frame members may also include a bottom surface that is adhered to or connected to the game board protector 2208 or game board 2208'. It should be understood that a variety of different configurations that reduce or illuminate the ability for food material to enter within the storage regions 2204 to occur. In an embodiment, a cover (not shown) may be included that covers one or more of the storage regions 2204.

With regard to FIGS. 23A-23D, a board game delivery device or mechanism 2302 may have the same or similar elements as the board game delivery device 2202 shown in FIG. 22. A game board protector 2208 or game board 2208' may be used. The game board protector 2308 or game board 2308' is shown to be half of the dimensions of the bottom of the pizza box 2302. In this case, the length of the game board protector 2308 or board game board 2308' is utilized. In such a case, the game board protector 2308 is shown to include a game board 2316 that is folded in half and inserted within the game board protector 2308 via an opening 2318. It should be understood that the game board protector 2308 or game board 2308' may have a variety of different configurations, such that a game board 2316 disposed within the game board protector 2308 may be configured to fit therein. For example, the game board protector 2308 or game board 2308' may be a fourth of the size of the bottom of the pizza box 2301, which either necessitates that the game board 2216 be smaller or fold the game board 2216 in quarters. Other folded configurations may be utilized, as well. The game board protector 2308 or game board 2308' should be food-safe, and avoid being contaminated with grease or other liquids or solids with which the game board protector 2308 or game board 2308' comes in contact.

One embodiment of a method of producing a delivery pizza may include placing a board game delivery device including a game board within a pizza box, and placing a pizza within the pizza box and on top of a portion of the board game delivery device. Inserting a board game delivery device may include inserting a board game delivery device inclusive of a game board protector, where the game board is disposed within the game board protector. In an alternative embodiment, the game board itself may be composed of a material that is food safe and a game may be printed on or in the material.

Inserting a board game delivery device may include inserting a board game delivery device that defines one or more storage regions between the pizza and adjacent side walls of the pizza box, whereby the one or more storage regions are configured to store one or more board game accessories therein. The board game accessories may include game pieces, cards, die or dice, and/or any other component of a board game. In either case, the game board protector or game board itself may be separable from partition and/or frame members of a container in which game pieces, for example, are to be placed.

The previous description is of a preferred embodiment for implementing the invention, and the scope of the invention should not necessarily be limited by this description. The scope of the present invention is instead defined by the following claims.

What is claimed:

1. A delivery pizza, comprising:

a pizza box having a top member and a bottom member, the bottom member including sidewalls and the top member including flaps that extend into a pizza region defined by the bottom member;

a pizza disposed within the pizza region of the bottom member;

a container disposed in a gap of the pizza region between the pizza and adjacent sidewalls, the container including at least one extender member configured to extend beneath the pizza; and an inedible item positioned in the container.

2. The delivery pizza according to claim 1, wherein the container has a pair of sidewalls and a curved wall between the sidewalls, and wherein the inedible item is disposed between the pair of sidewalls and curved wall.

3. The delivery pizza according to claim 1, wherein the container includes at least one flap connected to the sidewalls of the container, the at least one flap of the container being configured to extend below a flap of the top member when the flap of the top member is disposed within the pizza region of the bottom member and to be in contact with the at least one sidewall of the bottom member and between the flap of the top member and at least one sidewall of the bottom member.

4. The delivery pizza according to claim 1, wherein the container has a triangular shape.

5. The delivery pizza according to claim 1, wherein the container includes a top member that encloses the inedible item in the container.

6. A delivery pizza, comprising:

a pizza box having a top member and a bottom member, the bottom member including sidewalls and the top member including flaps that extend into a pizza region defined by the bottom member;

a pizza disposed within the pizza region of the bottom member;

a container disposed in a gap of the pizza region between the pizza and adjacent sidewalls, the container including at least one flap connected to the sidewalls of the container, the at least one flap of the container being configured to extend below a flap of the top member when the flap of the top member is disposed within the pizza region of the bottom member and to be in contact with the at least one sidewall of the bottom member and between the flap of the top member and at least one sidewall of the bottom member; and an inedible item positioned in the container.

* * * * *